United States Patent [19]

Ichise et al.

[11] 3,936,924

[45] Feb. 10, 1976

[54] RELEASEABLE STEEL CABLE ANCHOR AND METHOD FOR WITHDRAWING THE SAME

[76] Inventors: Yoshio Ichise, 20-6 Kitazawa 1-chome, Satagaya, Tokyo; Kinichiro Sato, 2-47 Nakamachi 1-chome, Kaganei, Tokyo, both of Japan

[22] Filed: Jan. 25, 1974

[21] Appl. No.: 436,547

[30] Foreign Application Priority Data

Sept. 21, 1973 Japan ..... 48-106601
Dec. 14, 1973 Japan ..... 48-140462

[52] U.S. Cl. ..... 29/427; 52/166; 61/45 B; 61/63

[51] Int. Cl.[2] ..... B23P 19/02

[58] Field of Search..... 61/45 B, 63; 52/166, 703, 52/155; 29/426, 427; 156/344; 249/213, 214

[56] References Cited

UNITED STATES PATENTS

| | | | |
|---|---|---|---|
| 3,050,436 | 8/1962 | Stepanski et al. | 29/427 |
| 3,326,004 | 6/1967 | Williams | 61/45 B |
| 3,379,019 | 4/1968 | Williams | 61/45 B |
| 3,615,960 | 10/1971 | Hoshii | 156/344 |
| 3,695,045 | 10/1972 | Williams | 61/45 B |
| 3,702,060 | 11/1972 | Cumming | 61/45 B |
| 3,738,071 | 6/1973 | Finsterwalder | 61/45 B |
| 3,753,354 | 8/1973 | Bauer | 61/45 B |
| 3,756,388 | 9/1973 | Murphy | 61/45 B |

*Primary Examiner*—C. W. Lanham
*Assistant Examiner*—James R. Duzan
*Attorney, Agent, or Firm*—Meyer, Tilberry & Body

[57] ABSTRACT

A releaseable steel cable anchor comprises a steel cable assembly encased within a thermoplastic resin which bonds the cable assembly to an anchor body embedded within the ground. Typically, the cable assembly is buried in a hole filled with a hardening material such as cement or mortar, which forms the anchor body. Either electrical heating wire or an elongated receptacle to receive a combustible material is provided along substantially the entire length of the resin encasing the cable assembly in order to melt and/or combust the resin material encasing the steel cables, whereupon the steel cables may be readily withdrawn from the anchor assembly.

A method for withdrawing the steel cable anchor from its embedded position in the ground comprises the steps of debonding, by melting or combustion, the encasing thermoplastic resin by either igniting a combustible material disposed within or adjacent the resin, or by passing electrical energy through a heating wire disposed along substantially the entire length of the encasing resin. A withdrawing force is then applied to the cable.

14 Claims, 12 Drawing Figures

RELEASEABLE STEEL CABLE ANCHOR AND METHOD FOR WITHDRAWING THE SAME

This invention relates to steel cable anchors which are embedded within the ground to provide an anchor to which a structural member may be attached.

This invention is more particularly concerned with a steel cable anchor which comprises one or a plurality of individual steel cables bundled together by binding wires or other suitable means and to a method for removing such steel cable anchors from the ground when they are no longer required.

Although it has broader applications, one aspect of the invention is particularly useful as it pertains to a method for use in removing, after use, a steel tension cable anchor from an elongated hole in the ground, in which hole the anchor was buried in a hardening material filling the hole.

In general, methods for fixing a steel cable anchor within the ground are well known and generally comprise drilling or otherwise forming a hole in the ground, inserting the cable anchor therein and filling the hole with a hardening material such as cement or mortar.

One known method for embedding an anchor in the ground comprises forming a suitable elongated hole in the ground and inserting an expansible tube therein. Mortar is injected about the outer circumference of the tube which is thereafter expanded to force the mortar against the walls of the hole, thereby consolidating the ground around the circumference of the hole as well as increasing the adhesive force of the mortar to the ground, so as to provide an increased resistance against withdrawal of the completed anchor. Into the hole formed in the mortar by withdrawal of the tube, a tension steel cable is inserted, and the cable is then bound therein by mortar or cement. Such anchors embedded within the ground are conventionally used to secure cables or structures such as sand guard walls, breast walls, revetments or the like. By whatever method it is formed, the anchor essentially consists of steel tension cables encased within mortar or cement in a hole in the ground.

In general, where a structure is supported by a steel tension cable anchor, there sometimes arises the need to provide one or moree cable anchors in an area, such as where a road or underground structure is to be built, from which the cable anchor cable must be removed after a certain stage of the construction is completed. In such cases, the steel cable anchor may be withdrawn by applying a force thereto which is greater than the tensile strength of the cable anchor so that it is forcibly torn from the ground. Alternatively, a heat producing charge, such as a thermite device, may be included in the construction of the steel cable anchor by being placed on a portion of the tension steel cable which is not covered with mortar or cement. When the cable anchor is no longer required, the thermite charge is ignited and the steel cable is severed by it and the severed portion removed.

Such prior art methods suffer from certain disadvantages. The former method (application of force) is inconvenient in requiring the application of enormous tensile forces to the cable to forcibly remove the same. The latter method (thermite charge) results in a failure to withdraw the whole body of the cable anchor, i.e., there remains a major portion of the steel cable anchor buried within the ground.

It is accordingly a principal object of the present invention to provide a steel cable anchor structure and a method for withdrawing the same from the ground after use, which method permits tensile force withdrawing of the cable anchor with much less force than that required by prior art withdrawal methods, and which permits recovery of the entire cable anchor.

Another object of the invention is to provide a tension steel cable anchor and method for withdrawing the same when it is no longer required, wherein means are provided for causing the combustion or fusion of a material such as a thermoplastic resin encasing the embedded tension steel cable.

Another object of the present invention is to provide a combustion member and/or substance within or adjacent the thermoplastic resin encasing the tension steel cables of a tension cable anchor, which member or substance may be used to cause the combustion or fusion of the encasing thermoplastic resin or other bonding material.

The present invention accordingly provides a steel cable anchor assembly and method for use in withdrawing the same, wherein one or more tension steel cables are encased within a bonding material, preferably a thermoplastic resin, which bonds the cables within an anchor body embedded in the ground so as to provide a substantial resistance against withdrawal of the anchor assembly by the pulling forces to which it is normally subjected, and means to carry out the combustion or fusion of the bonding material, i.e., the "debonding" thereof, so as to release the tension steel cables from the bonding material, whereby withdrawal of the tension steel cables from the anchor body may be achieved by the application of a minor withdrawing force thereto.

Any suitable material may be employed as the bonding material, provided it can bond with sufficient strength to the steel cables and the hardening material (cement, mortar) forming the anchor body, and can be fused or combusted in place to destroy its bonding strength by application of heat thereto. Thermoplastic resins, i.e., those which fuse upon application of heat thereto, are well suited for use in accordance with the invention, and are preferred. Epoxy resin, polyester resin and urethane resin are most preferred.

One embodiment of the present invention provides an electrical heating wire within or adjacent the thermoplastic resin which encases the tension steel cables, whereby the provision of electric current to the heating wires heats the encasing thermoplastic resin sufficiently to cause the fusion and/or combustion thereof, thereby facilitating the withdrawal of the tension steel cables.

In a modification of the foregoing, electric current is passed through the anchor elemental steel cables themselves, thereby heating them sufficiently to cause the combustion or fusion of the thermoplastic resin surrounding the bundled steel cables and facilitating their withdrawal.

In another embodiment, a conduit is provided within or adjacent the encasing thermoplastic material, and combustion means are provided therein to cause fusion and/or combustion of the thermoplastic material.

The combustion means may be a combustible powder or rod, or a burner may be employed to ignite gas mixtures within the conduit, or a combination of combustible powder, rod and gas mixture may be used.

Preferably, the electric heating wires, or the cables employed as such, and the conduit extend for substantially the entire length of the thermoplastic material encasing the steel tension cables. As used in the specification and claims, reference to the electrical heating wires being "disposed about" bonding material includes such wires being around, within or adjacent to such material.

Any suitable thermoplastic resin may be employed to encase the steel tension cables; epoxy resins, polyester resins and urethane resins are preferred.

Other objects and advantages of the present invention will become clear from considering in detail certain preferred embodiments of the invention described below in connection with the attached drawings which form a part hereof and wherein.

Figure 1:
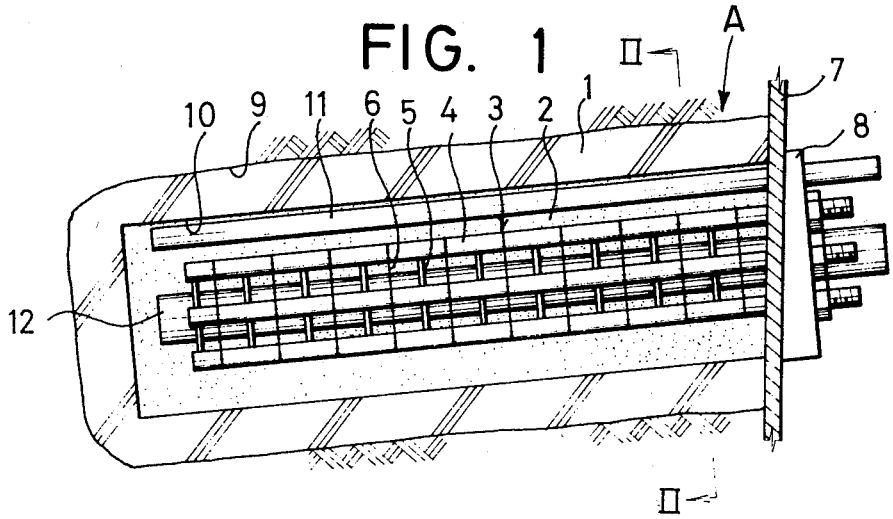
FIG. 1 is a longitudinal section view of one embodiment of the invention showing an encased steel cable anchor supporting a revetment wall, including combustion means to effect de-bonding of the encasing material.
Figure 2:
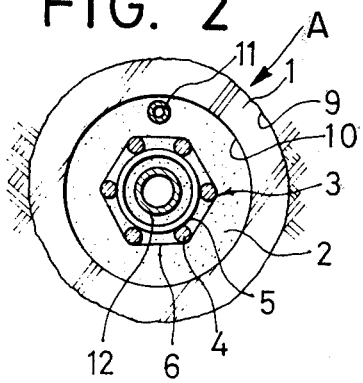
FIG. 2 is a cross-sectional view taken along line II—II of FIG. 1.

Referring now to FIGS. 1 and 2, an anchor assembly is generally indicated by the letter A. The anchor assembly is constructed, generally, by first preparing an elongated hole 9 in the ground, into which an expansible tube is inserted. Mortar or concrete is then injected between the tube and the hole. The expansible tube is thereafter caused to expand under hydraulic pressure, in the known manner, and pressure is thereby exerted on the mortar or concrete which is pressed against the surrounding earth under pressure while it hardens. Means are provided, also in the known manner, to prevent escape of the mortar under pressure from the opening of the hole 9. After the lapse of a suitable amount of time, the application of pressure is decreased in order to contract the expansible tube and the tube is withdrawn from the hole leaving behind a body of hardened mortar 1 having a hollow portion 10 formed therein. Thereafter, a tension steel cable assembly 3 is inserted within the hollow portion 10 of anchor body 1. Tension steel cable assembly 3 is composed of a plurality of individual steel cables 4 made of steel wire or steel rod. The plurality of individual cables 4 are disposed about the circumference of a plurality of hoop-like spacers 5, and bundled thereon by binding members 6, which advantageously may be wires.

Spacers 5 are distributed at spaced intervals along substantially the entire length of cable assembly 3, as shown in FIG. 1.

As also seen in FIG. 1, anchor assembly A, specifically cable assembly 3 thereof, is affixed in the known manner to a fixing member 8 which secures it against a revetment wall 7. Revetment wall 7 is thereby supported by the anchor assembly against the pressure of the earth, sand, etc. contained behind it.

The embodiments of the invention illustrated in the other FIGURES are also shown as connected to respective revetment walls 7 in similar fashion. Some parts of the anchor assemblies shown in the other FIGURES are numbered identically to corresponding parts shown in FIGS. 1 and 2.

A pipe 12, suitably made of a metal or synthetic resin, is inserted within cable assembly 3 by being passed through the center of hoop-like spacers 5, as best seen in FIG. 2.

A thermoplastic resin 2 is then charged into the hollow portion 10 of anchor body 1 by means of a pipe 11 inserted into hollow portion 10. Upon setting of the thermoplastic resin 2, cable assembly 3 is fixed in place within anchor body 1.

Thermoplastic resin 2 may be any suitable thermoplastic material such as an epoxy resin, polyester resin, urethane resin or the like. Generally, as aforesaid, in any embodiment of the invention, any material may be employed in place of resin 2, which material will harden in place to effectuate a strong bond between the cable assembly and the anchor body, and which, upon a suitable degree of heating, will either melt or fuse, or be combusted, so as to release the bonding force upon the cable assembly.

As explained in more detail hereinbelow, pipe 12 provides a conduit which serves as a receptacle for the insertion of a combustible material which is ignited therein when it is desired to effectuate loosening and withdrawal of tension steel cable assembly 3. Accordingly, one end of pipe 12 is accessible from the surface end of the anchor assembly to permit introduction of a combustible substance therein.

Figure 3:
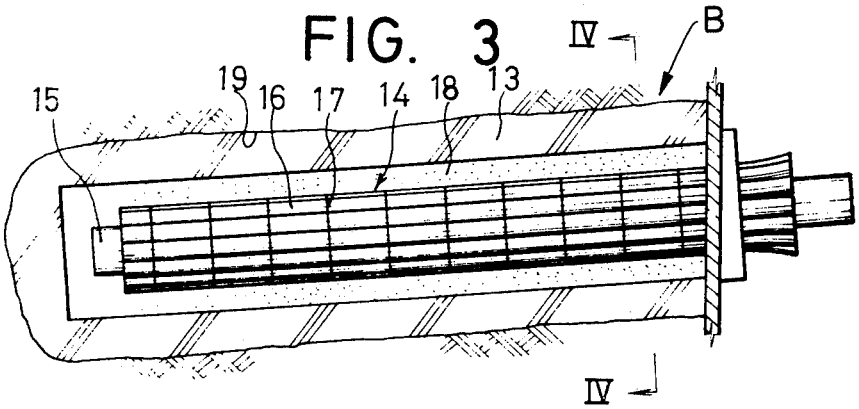
FIG. 3 is a longitudinal sectional view similar to that of FIG. 1 showing another embodiment of the invention including combustion means to effect de-bonding of the encasing material.
Figure 4:
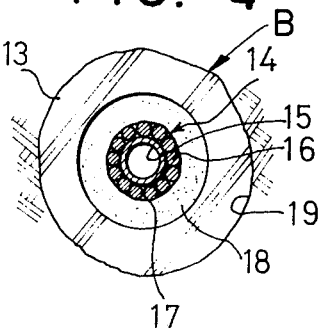
FIG. 4 is a cross-sectional view taken along line IV—IV of FIG. 3.

Referring now to FIGS. 3 and 4, an anchor assembly representing a different embodiment of the invention is generally designated by the letter B.

In this case, a tension steel cable assembly 14 is composed of a plurality of steel cables 16 disposed continuously about the circumference of a pipe 15, as best seen in FIG. 4. The plurality of steel cables 16 are bundled into a unitary structure by binding members 17 which may suitably be steel wire or steel banding.

A suitable thermoplastic resin 18 is applied to steel cable assembly 14 so as to entirely surround and encase tension steel cable assembly 14 in hardened thermoplastic resin 18. An elongated hole 19 is provided in the ground and encased cable assembly 14 is inserted therein. Thereafter, mortar or concrete 13 is inserted into hole 19 under pressure in the known manner to form anchor body 13 about tension steel cable assembly 14 and hardened resin 18 encasing it.

As shown in FIG. 3, pipe 15 is substantially coextensive with individual steel cables 16, actually extending somewhat beyond them. Similarly, with reference to FIGS. 1 and 2, pipe 12 is substantially coextensive with, i.e., extends slightly beyond, individual steel cables 4. Both pipes 12 and 15 provide a conduit or receptacle within which a suitable, non-explosive combustible powder, such as thermite powder, or black powder, or the like, may be charged, pipes 12 and 15 being accessible from their surface ends for the introduction of combustible substance therein. Alternatively, suitable burner means such as a gas burner or a jet flame burner such as one in which thyrosine and oxygen are employed as the main components for combustion, may be inserted within the pipe 12 or 15. As another alternative, a combustible rod such as an aluminum rod with carbon adhering therearound may be inserted into the pipe 12 or 15 and means for continually feeding oxygen therein may be supplied. Either or any of the above described means may be utilized to cause combustion, within the respective pipes 12 and 15, of sufficient intensity and duration to cause the de-bonding, by melting or combustion, of the respective thermoplastic resins 2 and 18, to thereby release the respective tension steel cable assemblies 3 and 14 from being bound to their respective anchor bodies 1 and 13. Thus, the easy withdrawal of the tension steel cables is permitted.

As used in this specification and in the claims, reference to the de-bonding of the thermoplastic resin or other bonding material means destruction of its bonding ability as by fusion or melting of the material, and/or combustion of the same. Similarly, reference to "cables" shall include steel rods such as reinforcing rods, as well as wire rope, strands, cables and the like.

An obvious alternative to the above described structure and procedure is to provide a hole or opening extending substantially throughout the body of hardened thermoplastic resin 2 or 18 for charging the combustible material therein, or accommodating a burner therein. That is to say, a pipe 12 or 15, while a convenient means of forming the receptacle conduit, need not necessarily be left behind in the completed structure, but a hole may be formed therein by any suitable means without the provision of a pipe.

Figure 5:
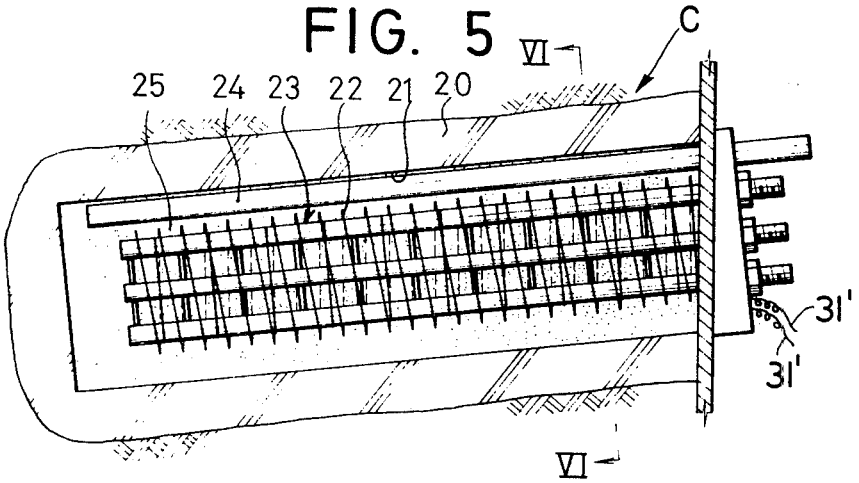
FIG. 5 is a longitudinal sectional view similar to that of FIG. 1, showing another embodiment of the invention including an electrical heating wire to effect de-bonding of the encasing material.
Figure 6:
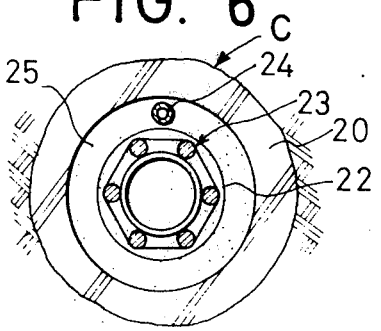
FIG. 6 is a cross-sectional view taken along line VI—VI of FIG. 5.

Referring now to FIGS. 5 and 6, an anchor assembly representing yet another embodiment of the invention is generally indicated by the letter C, and is generally similar to the construction shown in FIGS. 1 and 2. Thus, a plurality of steel tension cables 16 are assembled into a cable assembly 23 about the periphery of each of a series of hoop-like spacers 5, and held thereby by binding members 6. A continuous electrical heating wire 22 is wound about cable assembly 23 along substantially the entire length thereof, and is doubled back so that both free ends 22' are at the surface end of cable assembly 23. The free ends 22' are extended to project beyond revetment wall 7 in the finished assembly, and thus to provide means to connecting heating wire 22 to a source of electrical potential.

The anchor body 20 comprises a concrete or mortar member formed in the ground by any suitable means, and having a hollow portion 21 thereof into which the cable assembly 23 is inserted. A thermoplastic resin 25 is charged into the hollow portion 21 of anchor body 20 by a pipe 24 and, upon hardening, thermoplastic resin 25 provides a unitary anchor assembly, bonding cable assembly 23 to anchor body 20.

As explained in detail hereinbelow, by the passage of an electrical current through heating wire 22 the thermoplastic resin 25 bonding tension steel cable assembly 23 to anchor body 20 is de-bonded by melting the same.

Figure 7:
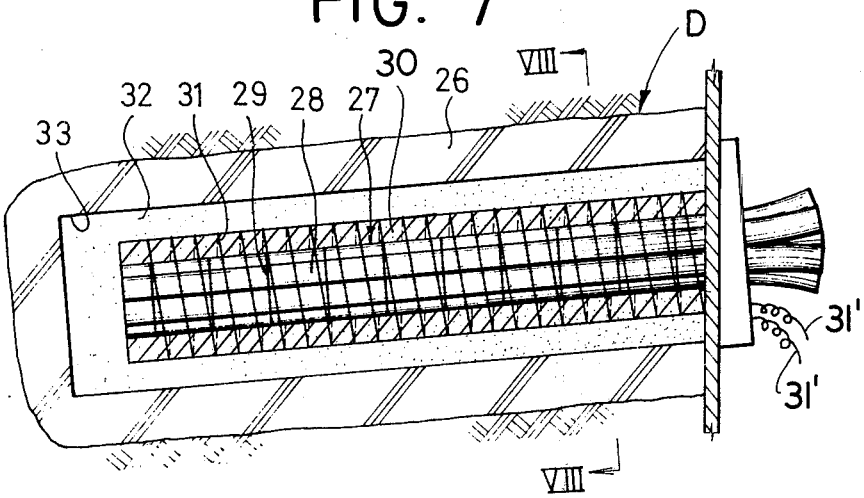
FIG. 7 is a longitudinal sectional view similar to that of FIG. 1, showing another embodiment of the invention including an alternative construction of electrical heating wires to effect de-bonding of the encasing material.
Figure 8:
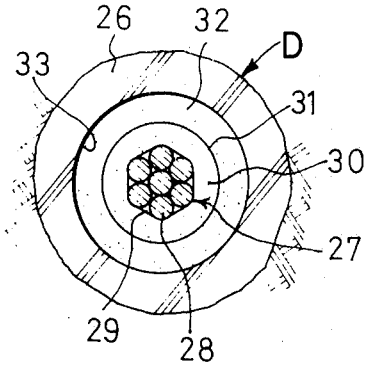
FIG. 8 is a cross-sectional view taken along the line VIII—VIII of FIG. 7.

Referring now to FIGS. 7 and 8, an anchor assembly representing yet another embodiment of the invention is generally indicated by the letter D. As shown in FIGS. 7 and 8, a tension steel cable assembly 27 is comprised of a plurality of individual steel cables 16 formed into a bundle by binding members 29 and encased within an electrical insulating material 30 which advantageously is a thermoplastic resin. A heating wire 31 is wound around substantially the entire length of insulating material 30 covering tension steel cable assembly 27, and is doubled back so that both free ends 31' are at the surface end of cable assembly 27. A covering of thermoplastic resin 32 is then formed about insulating material 30 and heating wire 31. The thus encased steel cable assembly 27 is inserted into an enlongated hole formed in the ground and mortar or concrete 26 is then inserted into the hole under pressure thereby completing the construction of the anchor assembly. The free ends 31' of heating wire 31 are extended beyond the surface end of the anchor assembly to project outside revetment wall 7. The free ends 31' thus provide means to connect the heating wire to a source of electrical potential.

When it is desired to remove respective anchor assemblies C or D, electric current is fed through the respective heating wires 22 and 31 whereupon respective bonding thermoplastic resins 25 and 32 and/or insulating material 30 is encased to be de-bonded by fusion and/or combustion thereof, which releases respective steel cable assemblies 23 and 27 so that they may be readily removed from the respective anchor assemblies.

Figure 9:
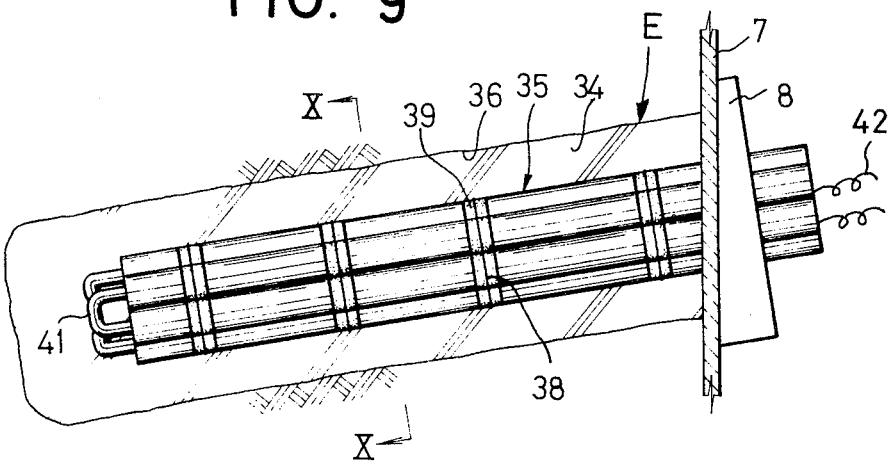
FIG. 9 is a longitudinal sectional view similar to that of FIG. 1, showing another embodiment of the invention including electrical connections to selected steel cables for heating to effect de-bonding of the encasing material.
Figure 10:
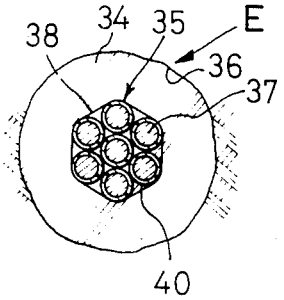
FIG. 10 is a cross-sectional view taken along line X—X of FIG. 9.
Figure 12:
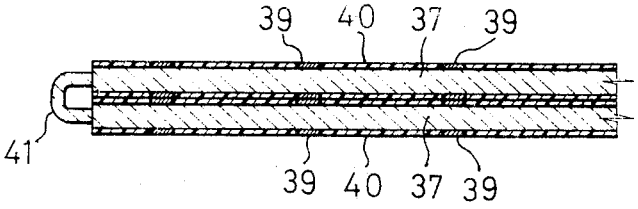

Referring now to FIGS. 9 and 10, an anchor assembly representing yet another embodiment of the invention is generally designated by the letter E. A tension steel cable assembly 35 is composed of a plurality of individual steel cables 37 bundled together by binding wires 38. Each individual steel cable 37 is covered at spaced intervals along the length thereof with strips of electrical insulating material 39, such as an insulating tape, glass wool, asbestos, or the like, wrapped around the circumference of each individual cable 37. As best seen in FIG. 12, the strips of electrical insulating material 39 are sufficiently thick and wide and located at repeated intervals spaced one from the other at distances close enough to prevent contact between adjacent individual steel cables 37. The portion of the circumference of the individual steel cables 37 not covered by insulating material 39 is enveloped in a suitable thermoplastic resin 40. Resin 40 may itself be an electrical insulating material, but the essential distinction is that resin 40 is fusible or combustible by the electrical current to be passed through the cables 37 as described hereinbelow, whereas insulating material 39 is not.

Pairs of individual steel cables 37 are connected in electric current flow communication by connecting wires 41 fastened thereto by any suitable means. Lead wires 42 are connected to the opposite (surface) end of such paired individual cables 37 in order to form an electric flow circuit through connected pairs of cables 37. Lead wires 42 provide means to connect the paired cables 37 to a source of electrical potential.

Figure 11:
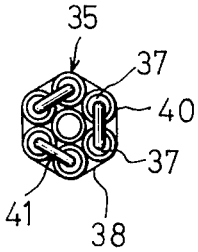
FIG. 11 is an end view of the tension steel cables of the anchor of FIG. 9 taken in the direction of the arrow F in FIG. 9; and, FIG. 12 is a cross-sectional view showing the electric connection between a pair of elemental steel cables typical of the connection of the cables in the embodiment of FIG. 9.

As shown in FIG. 11, in this particular case wherein one individual steel cable (in the center of the bundle) is entirely surrounded by other individual steel cables, the single cable which is in contact only with cables electrically connected in pairs is not itself connected into an electrical circuit.

In order to construct the anchor assembly E, tension steel cable assembly 35 made up of coated cables, is inserted into an elongated hole 36 bored in the ground, and a suitable mortar or cement 34 is injected therein under pressure to form the anchor assembly.

When it is desired to withdraw tension steel cable assembly 35 from the ground, lead wires 42, connected to a suitable source of electrical energy, are connected to respective pairs of individual steel cables 37 coupled by the connecting wire 41 into an electrical circuit. The electric current is fed thereto, which results in heating the cables 37 thereby causing destruction by combustion of fusion of bonding thermoplastic resin 40 surrounding individual steel cables 37. The individual cables 37 are thereby released from the disintegrating thermoplastic 40 and withdrawn from the anchor. Tension steel cable assembly 35 may be withdrawn as a unit, depending on its size, or individual paired cables 37, 37 may be withdrawn one at a time. Insulating material 39 is uneffected by the heating of cables 37 and the destruction of thermoplastic 40, and serves to maintain individual steel cables 37 separate one from the other to prevent short circuiting of the electric current during the heating operation. Thus, in this embodiment, the steel cables themselves serve as the heating wires.

While the invention has been described in detail with respect to specific embodiments thereof, it will be apparent upon a reading and understanding of the foregoing description that numerous modifications and alterations may be made to the specific structures and method described herein, which alterations and modifications are nonetheless within the spirit and scope of the present invention. It is intended to include all such modifications and alterations within the scope of the appended claims.

What is claimed is:

1. A method of withdrawing steel cables having terminal end portions from a cable anchor which includes at least one steel cable encased in a thermally fusible, combustible thermoplastic resin bonding material, having a fusing temperature and a combustion temperature, and embedded within a hardenable material, said method comprising the steps of: heating said thermally fusible bonding material within said hardenable material to at least said fusing temperature wherein said cable is debonded from said bonding material, and applying a tensional force longitudinally along said cable, thereby withdrawing said cable from said anchor.

2. The method described in claim 1 wherein said heating step further includes continuing said step of heating said bonding material above said combustion temperature.

3. The method of claim 1 wherein said step of heating comprises applying electric current to an electrical heating element wound around said steel cable along substantially its entire length within said bonding material of said cable anchor.

4. The method of claim 1 wherein the anchor contains a plurality of said steel cables, said cables being electrically connected in pairs at their terminal end portions and wherein said step of heating comprises applying an electrical current to said electrically connected pairs of said steel cables, each of which is otherwise electrically insulated from the remaining said steel cables within said anchor.

5. The method of claim 1, wherein said thermoplastic material is selected from the class consisting of epoxy resin, polyester resin, and urethane resin.

6. The method of claim 1, wherein said bonding material is heated by applying electrical current through an electrical heating conductor within said cable anchor.

7. The method of claim 1, wherein said bonding material is de-bonded by applying heat thereto by combusting a combustible substance.

8. The method of claim 7, wherein said combustible substance is selected from the class consisting of thermite powder and black powder.

9. The method of claim 7, wherein said combustible substance comprises a rod of combustible material.

10. The method of claim 9, wherein said combustible rod is made of aluminum and carbon.

11. The method of claim 7, wherein said combustible substance comprises a combustible gas.

12. The method of claim 11, wherein combustion means are employed to supply and ignite said combustible gas.

13. The method of claim 7, wherein said combustible substance is combusted within a receptacle supplied within said bonding material.

14. The method of claim 13, wherein said receptacle is a pipe disposed within said bonding material.

* * * * *